US007641504B1

(12) United States Patent
Padruzzi

(10) Patent No.: US 7,641,504 B1
(45) Date of Patent: Jan. 5, 2010

(54) ELECTRICAL CONNECTOR BACKSHELL ADAPTER

(76) Inventor: Jason Padruzzi, 7620 E. Osie, Suite B, Wichita, KS (US) 67207

( * ) Notice: Subject to any disclaimer, the term of this patent is extended or adjusted under 35 U.S.C. 154(b) by 0 days.

(21) Appl. No.: 12/167,339

(22) Filed: Jul. 3, 2008

(51) Int. Cl.
*H01R 13/58* (2006.01)

(52) U.S. Cl. ..... 439/467; 439/464

(58) Field of Classification Search ..... 439/464–470
See application file for complete search history.

(56) References Cited

U.S. PATENT DOCUMENTS

| | | | | |
|---|---|---|---|---|
| 2,737,543 | A | 3/1956 | Irwin | |
| 3,546,658 | A | 12/1970 | VanHorssen | |
| 3,675,184 | A | 7/1972 | Vetter | |
| 4,671,598 | A | 6/1987 | Keehne | |
| 4,770,642 | A * | 9/1988 | Van Hoose | 439/467 |
| 4,842,550 | A | 6/1989 | Fry, Jr. | |
| 4,902,248 | A | 2/1990 | Robertson et al. | |
| 5,158,481 | A | 10/1992 | Frantz | |
| 5,273,459 | A | 12/1993 | Davis | |
| 5,444,182 | A * | 8/1995 | Hoshino | 439/467 |
| 5,521,998 | A | 5/1996 | Walles | |
| 5,769,665 | A | 6/1998 | Neely et al. | |
| 6,161,282 | A | 12/2000 | Nieslony | |
| 6,203,362 | B1 | 3/2001 | Tsuji | |
| 6,364,693 | B1 * | 4/2002 | Stagg et al. | 439/467 |
| 6,918,785 | B1 | 7/2005 | Reilly | |
| 6,955,558 | B1 | 10/2005 | Low | |
| 7,112,094 | B2 * | 9/2006 | Reilly et al. | 439/610 |
| 7,201,603 | B1 | 4/2007 | Finona | |

FOREIGN PATENT DOCUMENTS

| | | |
|---|---|---|
| EP | 0125498 | 11/1984 |

OTHER PUBLICATIONS

Isodyne, Inc. , Tool-less Braid Termination System, Splice Kits , Date: unknown , Publisher: Isodyne, Inc. , Published Wichita, Kansas, U.S.

* cited by examiner

*Primary Examiner*—Briggitte R Hammond
(74) *Attorney, Agent, or Firm*—Kenneth H. Jack; Davis & Jack, L.L.C.

(57) ABSTRACT

An electrical connector backshell adapter for terminating sheathed electrical cables, the electrical connector backshell adapter having a housing having a first and at least a second port, the electrical connector backshell adapter further having a cable sheath termination nipple having a proximal end, the cable sheath termination nipple overlying the housing's first port, the cable sheath termination nipple's proximal end being fixedly attached to or formed wholly with the housing; the electrical connector backshell adapter further having a seam extending through the housing, the seam further extending through the cable sheath termination nipple, the seam dividing the housing into first and second housing sections, the seam further dividing the cable sheath termination nipple into first and second nipple sections, and the electrical connector backshell adapter further having a hinge connected operatively to the housing's first and second housing sections for motions of the first and second housing sections between opened and closed positions.

4 Claims, 6 Drawing Sheets

ELECTRICAL CONNECTOR BACKSHELL ADAPTER

FIELD OF THE INVENTION

This invention relates to electronic cable terminating devices and assemblies. More particularly, this invention relates to electronic cable terminating backshell adapters which are specially configured for attachment, termination, and support of protective cable sheathings.

BACKGROUND OF THE INVENTION

Cable sheath terminating backshell adapters are commonly provided in straight or 0°, 45°, and 90° angle configurations. An angled backshell adapter typically comprises both a cable receiving port and a cable terminating port, the openings of said ports typically being oriented at a 45° or 90° angle with respect to each other. Where a user of a 90° adapter attempts to install and utilize the adapter as a terminal cable harness component, the user typically initially extends an end of the cable into the adapter's cable receiving port. Continued extension of such cable into such port typically causes the cable end to abuttingly contact an opposing interior wall of the adapter's housing. Such contact often undesirably blocks continued progress of the insertion of the cables into and through the adapter. After such initial cable insertion step, the cable's end often is necessarily, but difficulty, manipulated and turned within the housing for further extension toward the backshell adapter's cable terminating port.

The instant inventive backshell adapter solves or ameliorates the above discussed problems and deficiencies of common angled cable sheath terminating backshell adapters by providing a seamed and section adapter configuration, by hingedly interconnecting such sections, and by orienting the seam so that commonly utilized cable sheath clamps may additionally and dually function as adapter section closing means.

BRIEF SUMMARY OF THE INVENTION

A first structural component of the instant inventive electrical connector backshell adapter comprises a hollow bored housing or conduit which presents both a first port or cable receiving port, and a second port or cable termination port. A hollow bored cable sheath termination nipple is necessarily provided, such nipple communicating with the cable receiving port. Preferably, the juncture of the housing and the cable sheath termination nipple comprises a whole formation of those two structures. The distal end of the cable sheath termination nipple preferably presents a wholly formed radially outwardly extending cable sheath retaining ridge.

A further structural element or feature of the instant inventive electrical connector backshell adapter comprises a seam which extends through the conduit or housing, and which preferably further extends longitudinally through the cable sheath termination nipple. The seam preferably divides the conduit or housing into first and second housing or conduit sections, and similarly divides the cable sheath termination nipple into corresponding first and second nipple sections, the first and second nipple sections respectively extending from the first and second housing sections. The backshell adapter's cable termination port preferably resides completely within one of the conduit or housing sections, the seam overlying such port and, unlike the sheath termination port, being seamless. Edges of the seam abut each other upon closure of the sections. Such edges are preferably configured to comprise nestable coffered steps which, upon closure and abutting contact, advantageously protect the seam from electromagnetic flux ingress.

A further structural component of the instant inventive electrical connector backshell adapter comprises pivotal attaching means connected operatively to the housing's or conduit's first and second sections, such means preferably facilitating motions of the pivotally conjoined sections between an opened cable receiving position and a closed cable retaining position. The pivotal attaching means preferably comprises a hinge selected from the group consisting of pin, eye, and clevis hinges, pin, sleeve, and clevis hinges, pintle hinges, open hook hinges, and living hinges.

A preferred further structural component of the instant inventive electrical connector backshell adapter comprises means for housing section closing and cable sheath clamping. Such means are preferably adapted for annular clamping engagement with the cable sheath termination nipple. Upon movement of the first and second housing and nipple sections to their closed cable retaining positions, and upon subsequent extension of the cable sheath termination nipple into an electric cable's protective sheath, the section closing and sheath clamping means may be extended annularly about the nipple and sheath. Upon such installation, such means advantageously dually functions for resisting movement of said sections toward their opened cable receiving positions, and annularly terminating and clamping the sheath about the cable terminating nipple. Said closing and clamping means is preferably of the type which will bind the sheath against the preferred sheath retaining ridge upon application of a pulling force to the cable.

Where the sheath termination nipple presents a substantially circular lateral cross-sectional shape, a preferred section closing and cable sheath clamping means comprises a spiral rarefaction spring (e.g., a Hunter, negator, or constant force spring). Such rarefaction spring is preferably installed annularly about the sheath termination nipple and about a sheath end which annularly overlies such nipple. The manner of installation disclosed in the U.S. Pat. No. 4,902,248 issued Feb. 20, 1990, to Robertson, et al., is preferred. Where such cross-sectional nipple shape is oblongated or oval, the section closing and cable sheath clamping means may suitably alternately comprise oppositely installed spring steel "C" clips mounted over the nipple and sheath assembly in the manner described in U.S. Pat. No. 6,918,785 issued Jul. 19, 2005 to Reilly. Other suitable section closing and sheath clamping means comprise buckle and band assemblies, heat shrinkable thermoplastic rings and tubes, crimped metal rings, and "magniform" rings.

Preferably, all components of the instant inventive electrical connector backshell adapter are composed of a radiopaque material such as a hardened aluminum alloy. Fabricating the inventive adapter of radiopaque material beneficially resists entry of electromagnetic flux into the interior spaces of the adapter.

In use of the instant inventive electrical connector backshell adapter, the seam defined housing or conduit sections, along with their corresponding seam defined nipple sections, may initially be hingedly moved to their opened cable receiving positions. Thereafter, a cable end extending from a protective cable sheath may be manually inserted into the interior space of the adapter. Such cable end may then be conveniently manually bent or turned within the housing's interior to match the bend angle (typically either 90° or 45°) of the adapter. Within such opened adapter, terminal connections at the adapter's cable termination port may be conveniently arranged and mounted to male or female terminals supported within such port. Thereafter, the adapter sections may be hingedly moved to their closed cable retaining positions resulting in reforming of the adapter's sheath termination nipple. Thereafter, the cable's protective sheath may be slidably extended over the nipple. Thereafter, section closing and cable sheath clamping means, such as a spiral rarefaction spring or paired "C" clips as discussed above, may be utilized for simultaneously annularly clamping the sheathing about the nipple, and holding the sections of the backshell adapter in their closed cable retaining positions. The dual functionality of the section closing and sheath clamping means advantageously promotes mechanical simplicity, costs economy, and ease of assembly and disassembly.

Accordingly, objects of the instant invention include the provision of an electrical connector backshell adapter which incorporates structural elements and features as described above, wherein such elements are arranged as described above for the performance of beneficial functions as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
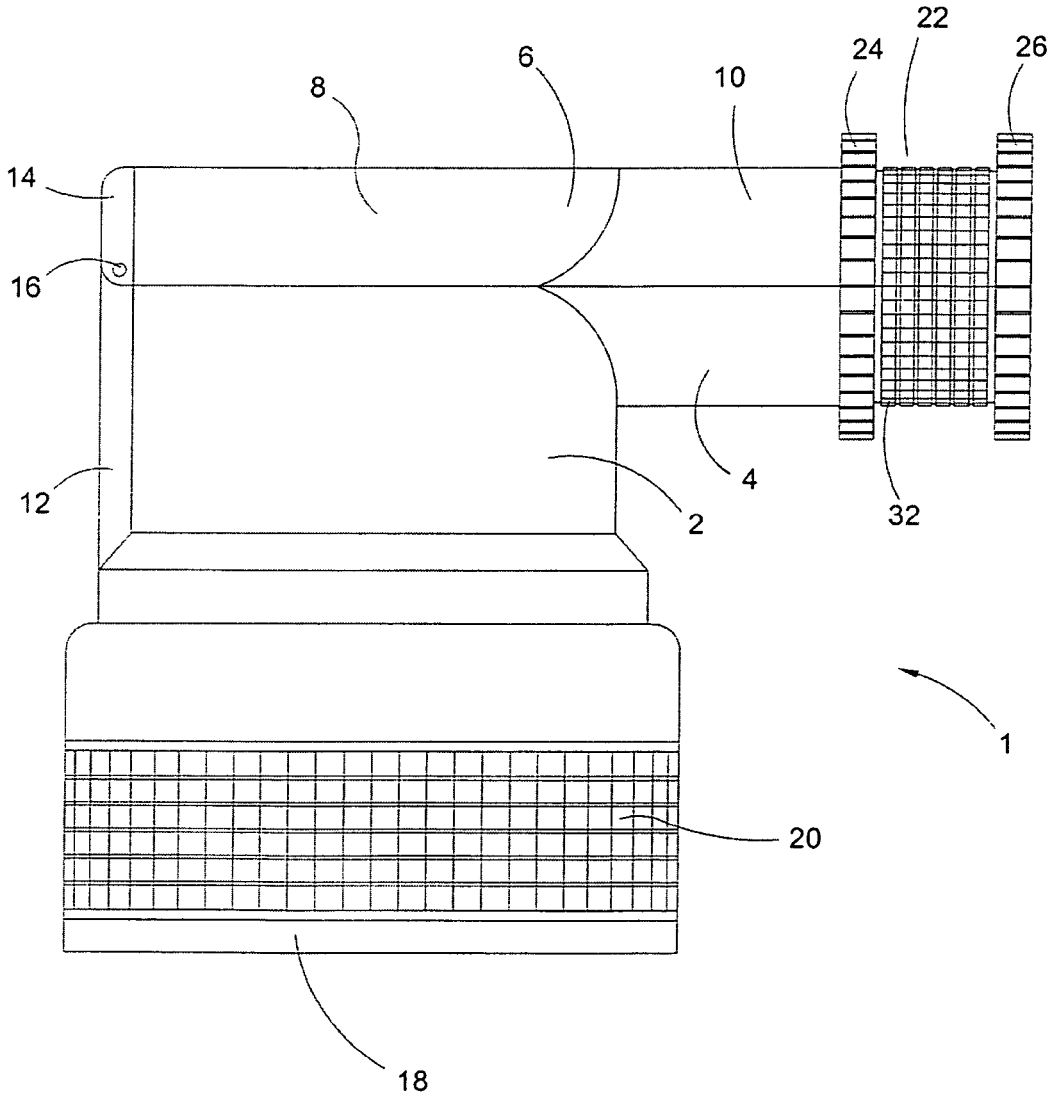
FIG. 1 is a side elevational view of a preferred embodiment of the instant inventive electrical connector backshell adapter.

Referring now to the drawings, and in particular to FIG. 1, a preferred embodiment of the instant inventive electrical connector backshell adapter is referred to generally by Reference Arrow 1. The adapter 1 preferably comprises a housing or conduit which is divided by a section defining seam 8, the seam 8 dividing the housing or conduit into housing sections 2 and 6. A sheath termination nipple, preferably comprising seam defined nipple sections 4 and 10, communicates with the housing. Preferably, the sheath termination nipple presents at its distal end a pair of knurled or ridged flanges 24 and 26, such flanges forming an annular fastener receiving channel 22. The floor of channel 22 preferably presents friction enhancing knurling 32.

Referring simultaneously to FIGS. 1, 2, 3, and 4, housing sections 2 and 6 are interconnected via pivotal attaching means which preferably comprise a sleeve 12, a clevis 14 receiving the sleeve 12, and a pivot pin 16 extending laterally through the clevis 14 and the sleeve 12. Pivotal motions of the seam defined housing and nipple sections 2, 4, 6, and 10 about pin 16 facilitate movement of such sections between the closed cable retaining position depicted in FIG. 1, and the opened cable receiving position depicted in FIGS. 2 and 4.

Figure 2:
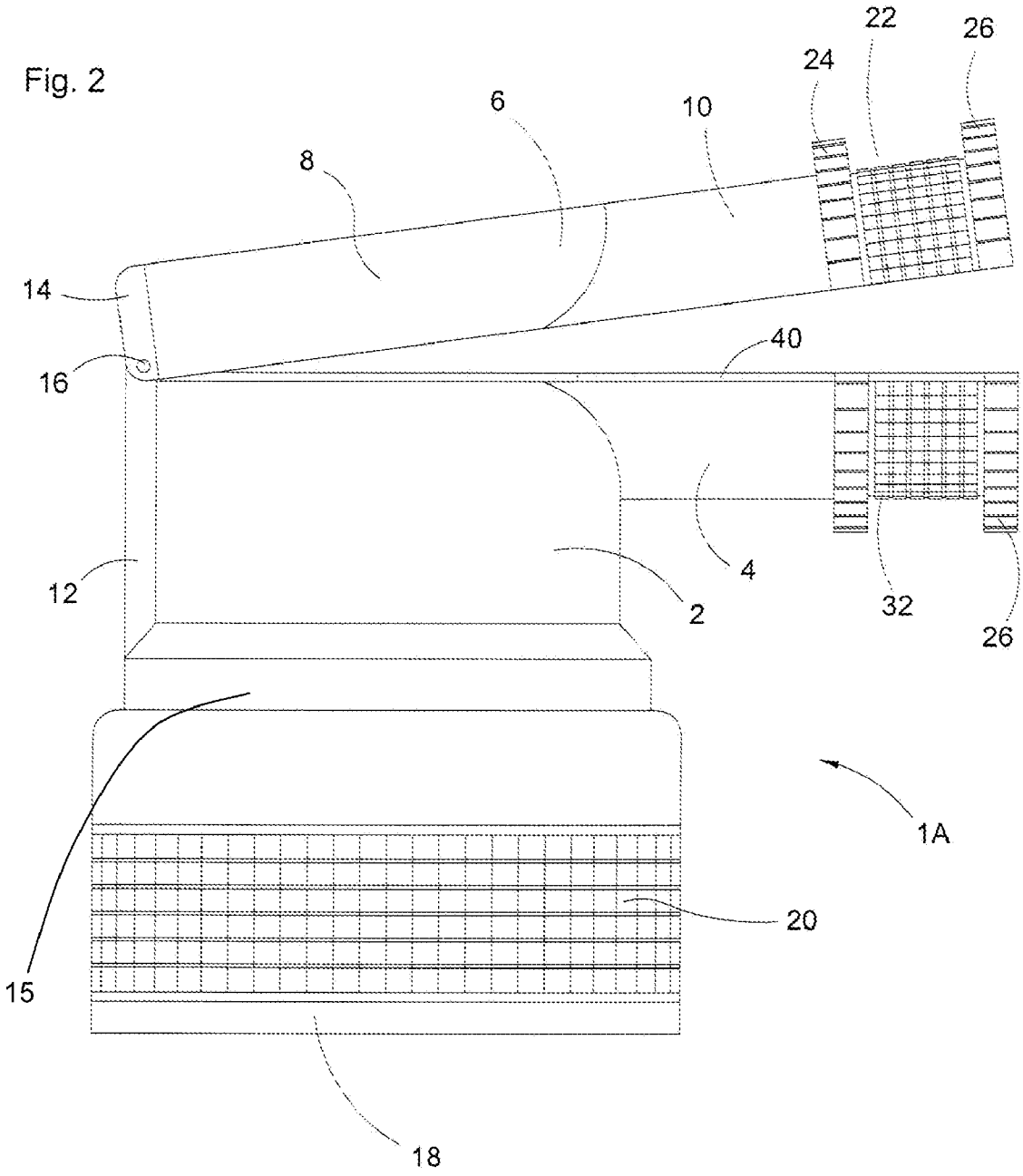
FIG. 2 redepicts FIG. 1, the view of FIG. 2 showing the adapter's seam defined housing/conduit and nipple sections pivotally moved toward their opened cable receiving positions.
Figure 3:
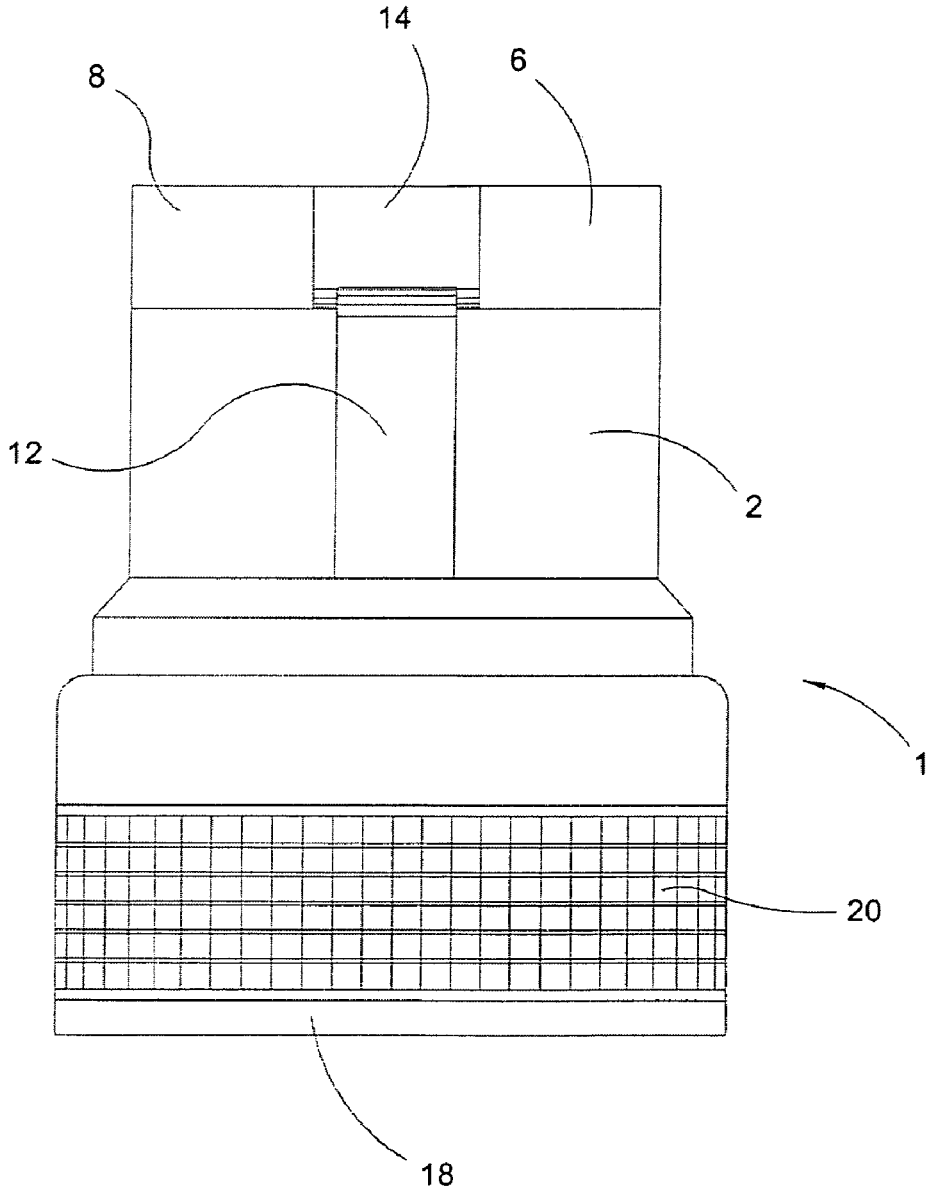
FIG. 3 is an end elevational view of the adapter depicted in FIG. 1.
Figure 4:
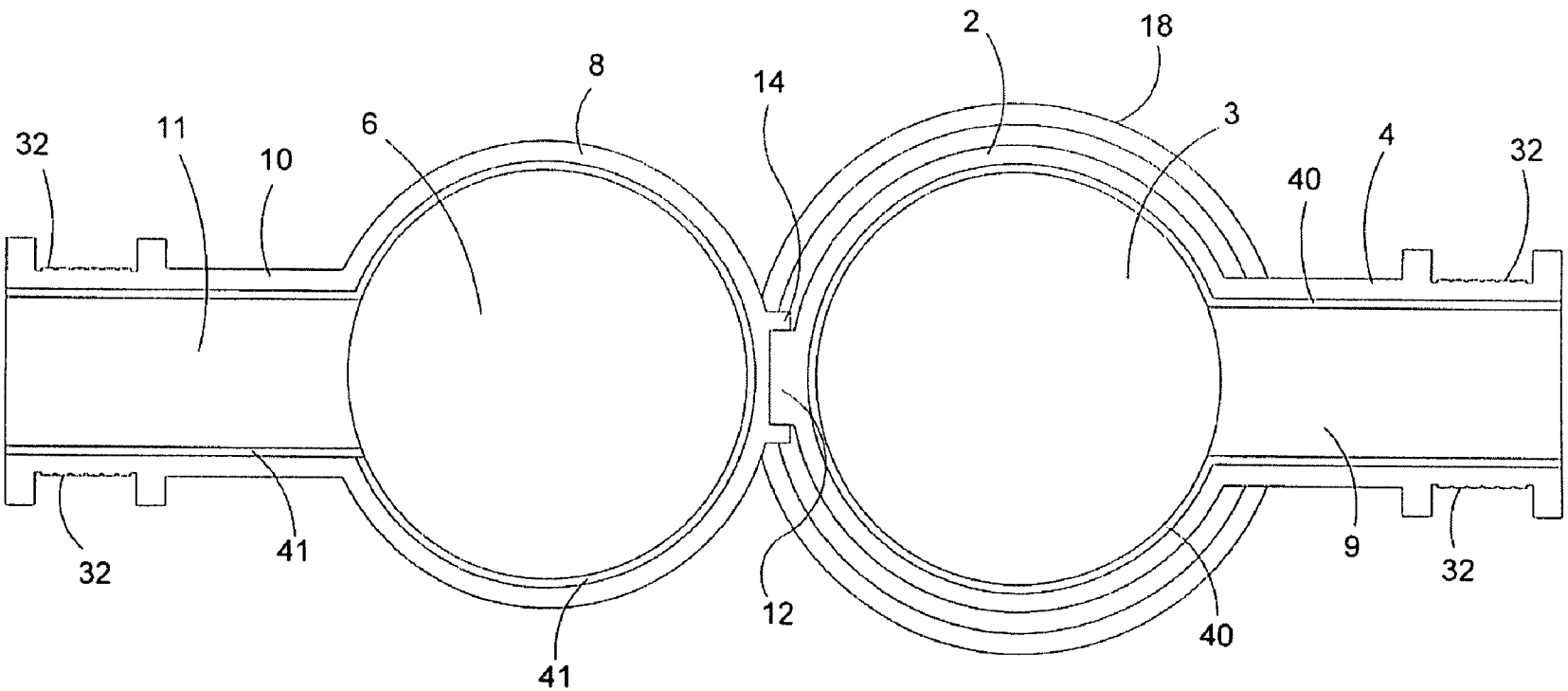
FIG. 4 is a plan view of the adapter depicted in FIG. 2, the view showing further pivotal opening of the seam defined housing/conduit and nipple sections.
Figure 5:
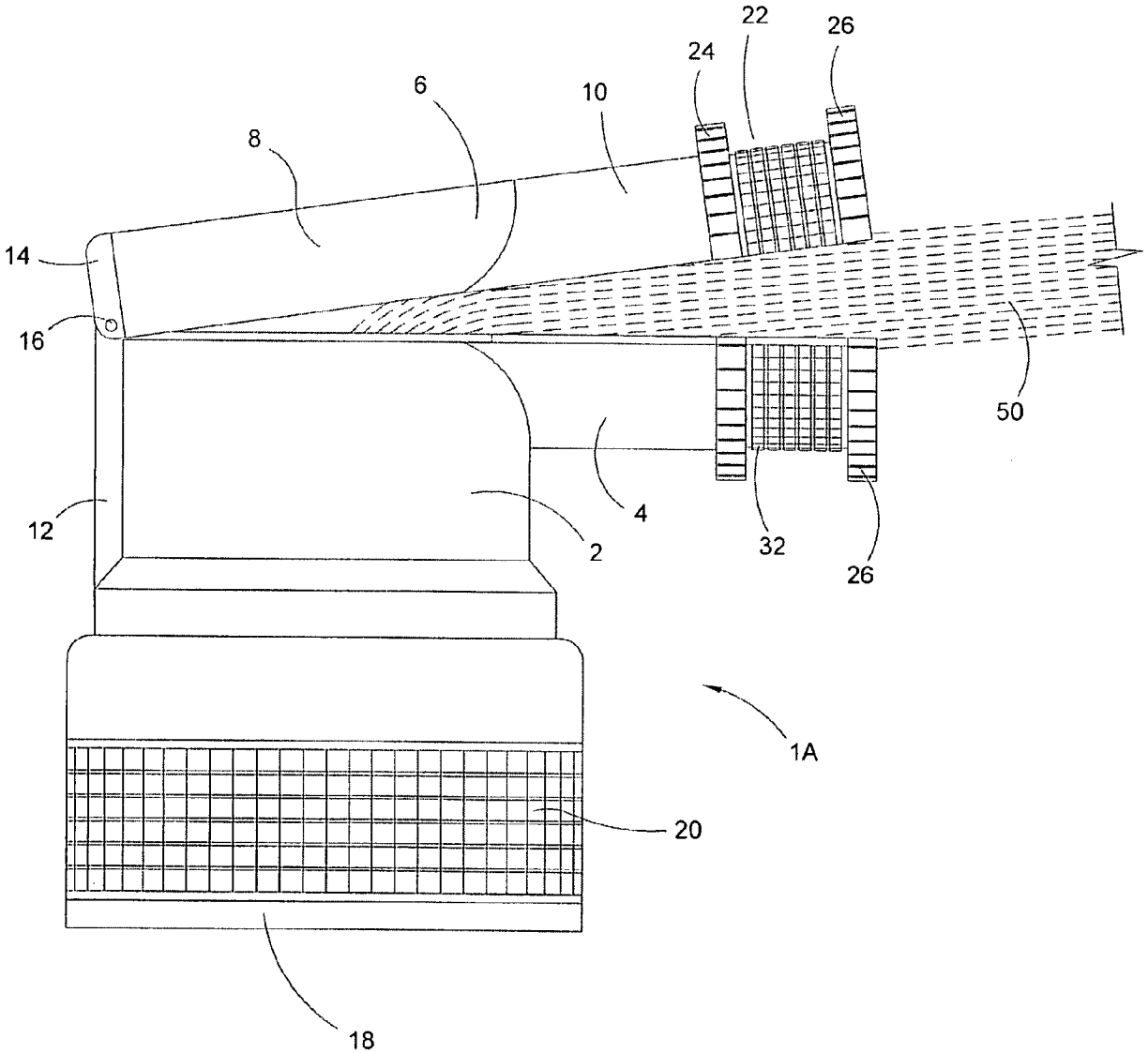
FIG. 5 redepicts FIG. 2, the view of FIG. 5 additionally showing cables (depicted in ghost, or dashed lines), the cables being received within the hollow interior spaces of the adapter.
Figure 6:
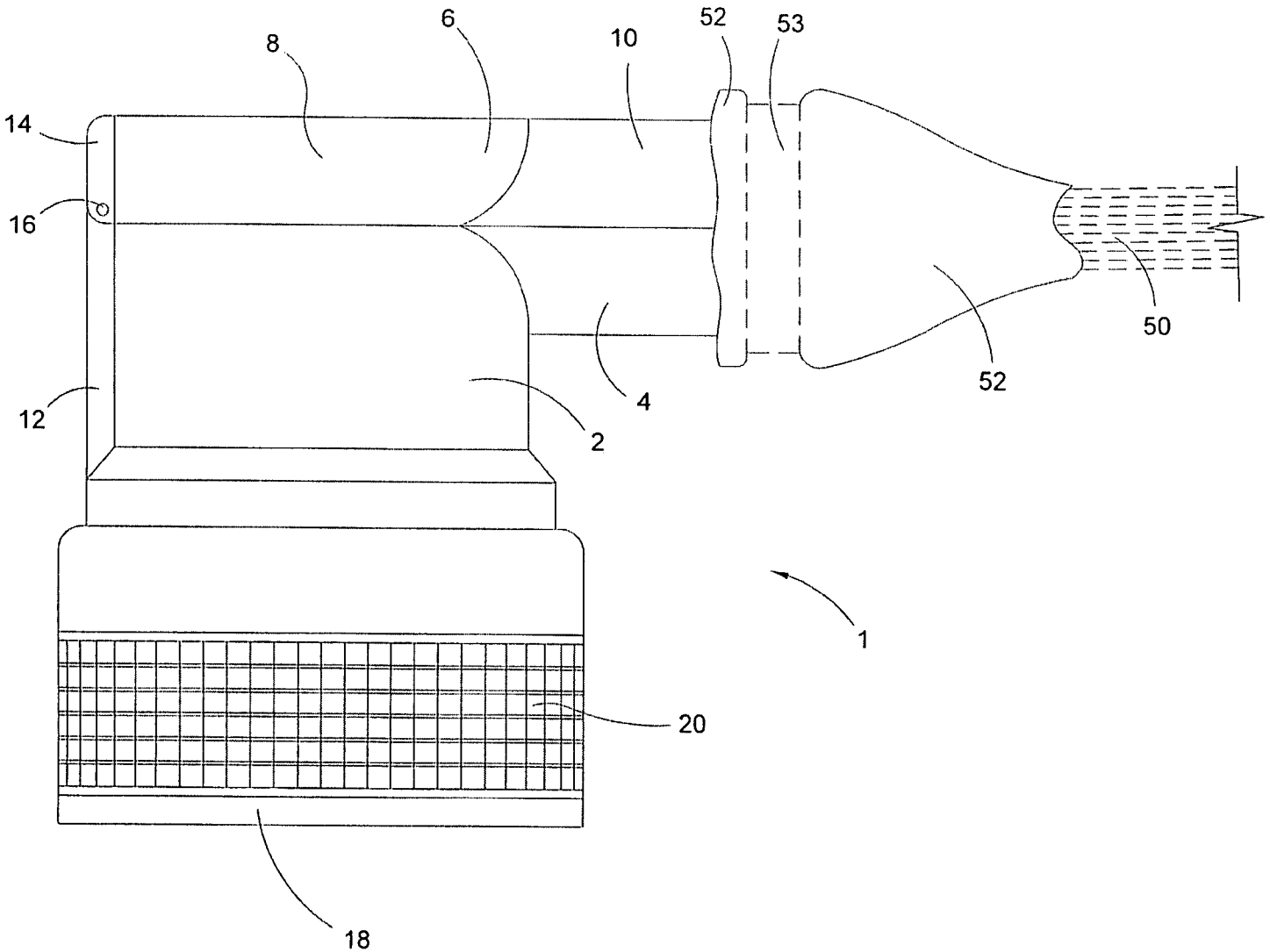
FIG. 6 redepicts FIG. 1, the view of FIG. 6 additionally showing (in ghost), a sheathed cable and a representationally depicted section closing and sheath clamping means.

Referring simultaneously to FIGS. 2 and 4, the abutting edges or faces of the seam 8 are preferably configured to include nestable coffered steps 40 and 41. Where the adapter is composed of radiopaque materials such as aluminum, overlapping surfaces of such coffered steps 40 and 41 advantageously resist ingress of electromagnetic flux.

Referring further simultaneously to FIGS. 2 and 4, upon full opening pivotal motions of housing sections 2 and 6, as depicted in FIG. 4, the semi-circular bores 9 and 11 of the sheath termination nipple are exposed, while the cable termination port 3 of housing section 2 is exposed. The cable termination port 3 preferably comprises and is defined by a coupling nut support nipple 15 which supports a rotatable coupling nut 18 having friction enhancing knurling 20. In use of the instant inventive electrical connector backshell adapter, referring simultaneously to FIGS. 1-5, a user may grasp housing section 2 in one hand, and may thereafter may apply finger pressure to housing section 6 to pivot said section about pivot pin 16. Such pivotal motion may articulate housing section 6 through the partially opened position depicted in FIG. 2, to a fully opened cable receiving position as depicted in FIG. 4. Upon opening articulation of section 6, a bundle of cables 50 may be manually placed into the semi-circular channel 9 of nipple section 4 so that the end of such cable bundle 50 overlies cable termination port 3. Thereafter, such cables 50 may be manually extended approximately 90° toward the cable termination port 3, causing such cables to flexibly bend to match the 90° configuration of the depicted backshell adapter. Thereafter, housing section 6 may be manually counter-pivoted about pivot pin 16, causing the opposite semi-circular channel 11 of nipple section 10 to similarly nestingly receive the cable bundle 50. Upon complete closing movement of housing sections 2 and 6 and nipple sections 4 and 10 to their cable retaining positions, the cable termination nipple 4 and 10 becomes reformed. Upon the nipple's reformation, overlapping coffered steps 40 and 41 along seam 8 advantageously resist ingress of electromagnetic flux. Thereafter, a terminal end of a protective cable sheath 52 may be slidably moved forwardly along cable bundle 50 until the end of such sheath overlies the distal end of the cable termination nipple. Thereafter, section closing and sheath clamping means depicted representationally by dashed line rectangle 53 are preferably extended annularly about the sheath termination nipple so that the sheath 52 is annularly inwardly compressed into the nipple's channel 22. Preferably, the section closing and sheath clamping means comprises a spiral rarefaction spring or constant force spring. Other annular clamping means such as "C" clips, magniform rings, buckle and band combinations, crimped bands and rings, and heat shrinkable rings and tubes may be alternately utilized as the section closing and sheath clamping means. Upon application of a rearward pulling force to the cable bundle 50 and to the sheath 52, the extreme distal sheath retaining ridge 26 of the cable termination nipple, in combination with the section closing and sheath clamping means 53, effectively binds the sheath 52 against the ridge 26 for securely resisting such pulling force.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An electrical connector backshell adapter for terminating a sheathed electrical cable, the electrical connector backshell adapter comprising:

(a) a housing having a first port and a second port;

(b) a cable sheath termination nipple, the cable sheath termination nipple communicating with the housing's first port;

(c) a seam extending through the housing, the seam further extending through the cable sheath termination nipple, the seam dividing the housing into first and second housing sections, the seam further dividing the cable sheath termination nipple into first and second nipple sections; and (d) pivotal attaching means, the pivotal attaching means being connected operatively to the housing's first and second housing sections for motions of the first and second housing sections and their respective first and second nipple sections between cable receiving and cable retaining positions and further comprising a coupling nut support nipple, the coupling nut support nipple communicating with the housing's second port, and further comprising a coupling nut mounted rotatably upon the coupling nut support nipple.

2. The electrical connector backshell adapter of claim 1 wherein the housing, the cable sheath termination nipple, the coupling nut support nipple, and the coupling nut comprise a radiopaque material.

3. An electrical connector backshell adapter for terminating a sheathed electrical cable, the electrical connector backshell adapter comprising:

(a) a conduit having a cable receiving end and having a seamless cable terminating end;

(b) a cable sheath termination nipple communicating with the conduit's cable receiving end;

(c) a seam extending through the conduit, the seam further extending through the cable sheath termination nipple, the seam dividing the conduit into first and second conduit sections, the seam further dividing the cable sheath termination nipple into first and second nipple sections; and (d) pivotal attaching means, the pivotal attaching means being connected operatively to the conduit's first and second conduit sections for motions of the first and second conduit sections and their respective first and second nipple sections between cable receiving and cable retaining positions and further comprising a coupling nut support nipple communicating with the conduit's seamless cable terminating end, and further comprising a coupling nut mounted rotatably upon the coupling nut support nipple.

4. The electrical connector backshell adapter of claim 3 wherein the conduit, the cable sheath termination nipple, the coupling nut support nipple, and the coupling nut comprise a radiopaque material.

* * * * *